US007373891B2

(12) United States Patent
Koerner

(10) Patent No.: US 7,373,891 B2
(45) Date of Patent: May 20, 2008

(54) QUILTING METHOD AND APPARATUS USING FRAME WITH MOTION DETECTOR

(76) Inventor: Ralph J. Koerner, P.O. Box 1320, Ramona, CA (US) 92065

( * ) Notice: Subject to any disclaimer, the term of this patent is extended or adjusted under 35 U.S.C. 154(b) by 0 days.

(21) Appl. No.: 10/590,180

(22) PCT Filed: Apr. 26, 2005

(86) PCT No.: PCT/US2005/014375

§ 371 (c)(1),
(2), (4) Date: Aug. 22, 2006

(87) PCT Pub. No.: WO2005/113876

PCT Pub. Date: Dec. 1, 2005

(65) Prior Publication Data

US 2007/0221108 A1 Sep. 27, 2007

Related U.S. Application Data

(63) Continuation-in-part of application No. 10/776,355, filed on Feb. 11, 2004, now Pat. No. 6,883,446.

(60) Provisional application No. 60/447,159, filed on Feb. 12, 2003.

(51) Int. Cl.
*D05B 1/00* (2006.01)

(52) U.S. Cl. ..... 112/475.02; 112/103; 112/272

(58) Field of Classification Search ..... 112/102.5, 112/103, 117–119, 271, 272, 274, 275, 277, 112/306, 308, 311, 315, 470.03, 470.14, 475.02, 112/475.03; 700/130, 136
See application file for complete search history.

(56) References Cited

U.S. PATENT DOCUMENTS

| | | | | |
|---|---|---|---|---|
| 4,860,675 | A * | 8/1989 | Brower et al. | 112/119 |
| 5,664,508 | A * | 9/1997 | Mulcahey et al. | 112/2.1 |
| 6,341,569 | B2 * | 1/2002 | Furuichi et al. | 112/475.02 |
| 6,450,110 | B1 * | 9/2002 | Bruhl et al. | 112/470.01 |
| 6,470,813 | B2 * | 10/2002 | Ebata et al. | 112/102.5 |
| 6,718,893 | B1 * | 4/2004 | Kong | 112/102.5 |
| 6,871,606 | B2 * | 3/2005 | Schweizer | 112/475.02 |
| 6,883,446 | B2 * | 4/2005 | Koerner | 112/272 |
| 6,959,657 | B1 * | 11/2005 | Duval | 112/272 |
| 6,994,042 | B2 * | 2/2006 | Schweizer | 112/470.03 |
| 2001/0050036 | A1 * | 12/2001 | Ebata et al. | 112/102.5 |
| 2002/0083873 | A1 * | 7/2002 | Sano et al. | 112/102.5 |
| 2003/0130773 | A1 * | 7/2003 | Schweizer | 112/102.5 |
| 2005/0016428 | A1 * | 1/2005 | Koerner | 112/117 |
| 2005/0115482 | A1 * | 6/2005 | Schweizer | 112/470.01 |
| 2005/0145149 | A1 * | 7/2005 | Hooke | 112/315 |

* cited by examiner

*Primary Examiner*—Gary L. Welch
*Assistant Examiner*—Nathan E Durham
(74) *Attorney, Agent, or Firm*—Freilich, Hornbaker & Rosen

(57) ABSTRACT

A frame is provided for mounting a fabric layer stack and retaining it in a substantially taut condition. The frame is supported for manually guided movement beneath a fixedly located stitch head and a detector is provided to produce signals representing the magnitude of frame translation, and thus the magnitude of stack translation. The detector signals are applied to control circuitry to actuate the stitch head at a rate related to stack translation speed. The frame is supported by bearings; wheels, slides, etc, which permit the frame to be freely manually guided across a frame supporting surface beneath the stitch head.

15 Claims, 10 Drawing Sheets

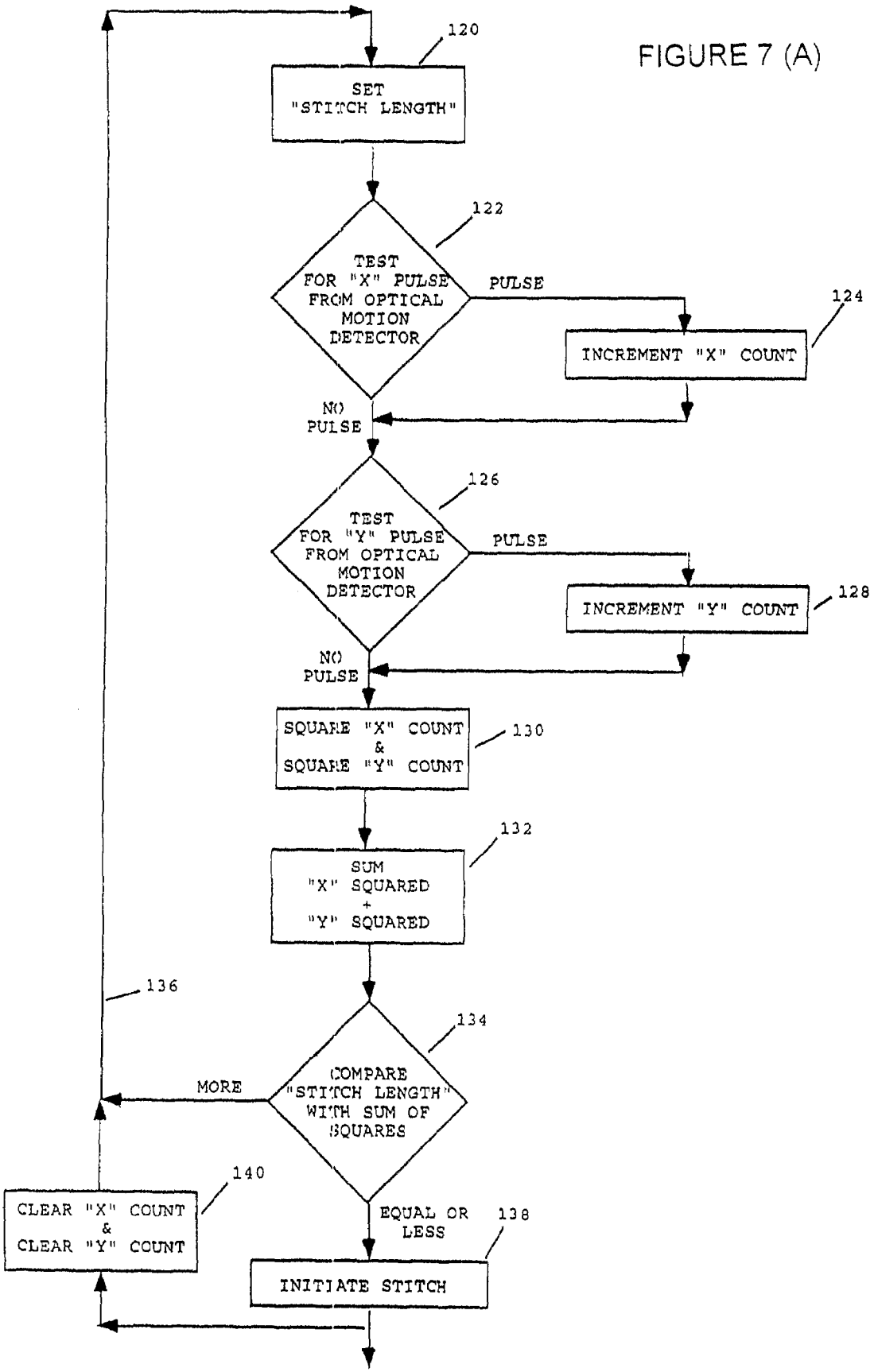
FIGURE 7 (A)
120
SET "STITCH LENGTH"
122
TEST FOR "X" PULSE FROM OPTICAL MOTION DETECTOR
PULSE
124
INCREMENT "X" COUNT
NO PULSE
126
TEST FOR "Y" PULSE FROM OPTICAL MOTION DETECTOR
PULSE
128
INCREMENT "Y" COUNT
NO PULSE
SQUARE "X" COUNT & SQUARE "Y" COUNT
130
132
SUM "X" SQUARED + "Y" SQUARED
136
134
COMPARE "STITCH LENGTH" WITH SUM OF SQUARES
MORE
140
CLEAR "X" COUNT & CLEAR "Y" COUNT
EQUAL OR LESS
138
INITIATE STITCH

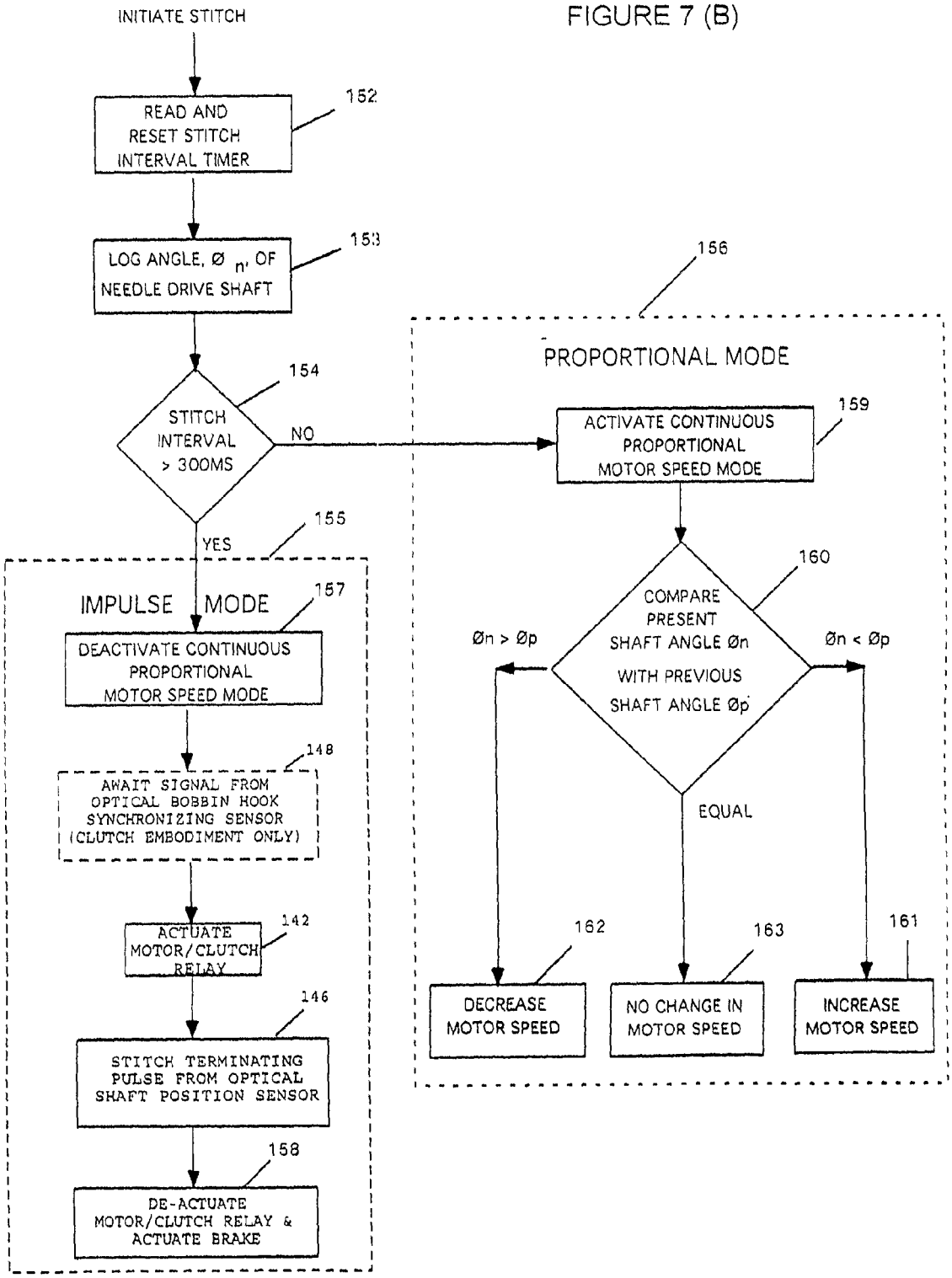
FIGURE 7 (B)
INITIATE STITCH
READ AND RESET STITCH INTERVAL TIMER
152
LOG ANGLE, Ø n, OF NEEDLE DRIVE SHAFT
153
STITCH INTERVAL > 300MS
154
NO
YES
155
IMPULSE MODE
157
DEACTIVATE CONTINUOUS PROPORTIONAL MOTOR SPEED MODE
148
AWAIT SIGNAL FROM OPTICAL BOBBIN HOOK SYNCHRONIZING SENSOR (CLUTCH EMBODIMENT ONLY)
ACTUATE MOTOR/CLUTCH RELAY
142
146
STITCH TERMINATING PULSE FROM OPTICAL SHAFT POSITION SENSOR
158
DE-ACTUATE MOTOR/CLUTCH RELAY & ACTUATE BRAKE
156
PROPORTIONAL MODE
ACTIVATE CONTINUOUS PROPORTIONAL MOTOR SPEED MODE
159
COMPARE PRESENT SHAFT ANGLE Øn WITH PREVIOUS SHAFT ANGLE Øp
160
Øn > Øp
Øn < Øp
EQUAL
DECREASE MOTOR SPEED
162
NO CHANGE IN MOTOR SPEED
163
INCREASE MOTOR SPEED
161

QUILTING METHOD AND APPARATUS USING FRAME WITH MOTION DETECTOR

This application is a continuation-in-part of U.S. application Ser. No. 10/776,355 filed on 11 Feb. 2004 now U.S. Pat. No. 6,883,446 which claims priority based on U.S. application Ser. No. 60/447,159 filed on 12 Feb. 2003. Said application Ser. No. 10/776,355 issued as U.S. Pat. No. 6,883,446 on 26 Apr. 2005.

FIELD OF THE INVENTION

This invention relates generally to a method and apparatus for stitching together fabric layers and more particularly to a fabric retaining frame adapted for manually guided movement for controlling actuation of a stitch head.

BACKGROUND OF THE INVENTION

Creating decorative quilts by hand has become a popular avocation. A typical quilt is comprised of at least two fabric layers which are stacked and stitched together. Generally the quilt is comprised of a "top" layer, a "bottom" or "backing" layer, and an intermediate "batting" layer. The top layer is typically decorative and is produced as a consequence of the creative and artistic effort of the quilt maker. The backing layer is usually simple and aesthetically compatible with the top. The batting layer generally provides bulk and insulation. The specific process of sewing the sandwich of the three planar layers together is generally referred to as "quilting". The quilting process usually consists of forming long continuous patterns of stitches which extend through and secure the top, backing, and batting layers together. Oftentimes stitch patterns are selected which have a decorative quality to enhance the overall aesthetics. A general goal of the quilting process is to produce precise consistent stitches that are closely and uniformly spaced.

Quilting traditionally has been performed by hand without the aid of a sewing machine. However, hand quilting is a labor-intensive process which can require many months of effort by a practiced person to create a single quilt. Accordingly, it appears that a trend is developing toward using machines to assist in the quilting process to allow most of the quilter's effort to be directed toward the creative and artistic aspects of the top layer.

Machine quilting can be performed in a variety of ways. For example, a user can operate a substantially conventional sewing machine in a "free motion" mode by removing or disabling the machine's feed dogs. This allows the user to manually move the stacked quilt layers relative to the machine's needle, either directly or via a quilt frame, to produce desired patterns of stitches. In practice, the sewing machine is run at a relatively constant speed as the user moves the stacked quilt materials under the needle. This process typically requires significant operator skill acquired after much practice to enable the operator to move the quilt stack in synchronism with the needle stroke to form high quality stitch patterns. Thus, free motion quilting with a conventional sewing machine requires significant user skill and yet frequently yields imperfect results, particularly when forming curved and intricate stitch patterns.

Machine quilting can also be performed by using a wide range of specialized hand guided quilting systems which have become available in recent years. The characteristics and features of such systems are discussed in an article which appeared in *Quilter's Newsletter Magazine* (QNM), April 2003, by Carol A. Thelen. The article identifies three categories of such systems; i.e., (1) Table top set-ups, (2) Shortarm systems, and (3) Longarm systems. They are generally characterized by a table which supports a frame and a quilting/sewing machine. The frame includes rollers which hold the quilt layers so as to enable a portion of the layered stack to be exposed for stitching while the remaining layer portions are stored on the rollers. The quilting/sewing machine rests on a carriage mounted for movement (e.g., along tracks) relative to the frame and table. The carriage is generally provided with handles enabling an operator to move the machine over the surface of the quilt. The QNM article further discusses optional add-ons and accessories enabling various electronic functions, including stitch regulation, to be added to basic shortarm or longarm systems.

Applicant's U.S. Pat. No. 6,883,446 describes an apparatus which permits a user to manually move a stack of fabric layers across a planar bed, or plate, beneath an actuatable stitch head. The apparatus includes a detector for detecting the movement of the stack for the purpose of synchronizing the delivery of stitch strokes to the stack movement. This approach enables the insertion of uniform length stitches while allowing the user to move the stack within a wide range of speeds, to start or stop the stack movement at will, and to guide the stack in any direction across the planar bed.

The preferred embodiments described in applicant's U.S. Pat. No. 6,883,446 employ a detector configured to detect stack movement within the throat space of a quilting/sewing machine by measuring the movement of at least one surface of the stack as it moves across the planar bed. As described, a preferred detector responds to energy, e.g., light, reflected from a target area on the stack surface (top and/or bottom) within the machine's throat space. The detector preferably provides output pulses representative of incremental translational movement of the stack along perpendicular X and Y directions. The output pulses are processed to determine the distance the stack moves. When the cumulative stack movement exceeds a threshold magnitude, a "stitch stroke" command is issued to cause the stitch head to insert a stitch through the stacked layers. As the user moves the stack across the planar bed, additional stitch stroke commands are successively issued to produce successive stitches.

Applicant's U.S. Pat. No. 6,883,446 primarily contemplates that the user directly grasp, or touch, the stacked fabric layers to push and/or pull the stack across the planar bed. However, the application also recognizes that the user could, alternatively, mount the stack on a conventional quilt frame and then grasp the frame to move the stack across the planar bed to enable the detector to sense stack surface movement.

SUMMARY OF THE INVENTION

The present invention is directed to alternative embodiments for controlling stitch head actuation to insert uniform length stitches into a stack of fabric layers. In accordance with the present invention, a frame is provided for mounting the fabric layer stack and retaining it in a substantially taut condition. The frame is supported for user guided movement beneath a fixedly located stitch head and a detector is provided to produce signals representing the magnitude of frame translation, and thus the magnitude of stack translation. As in applicant's U.S. Pat. No. 6,883,446, when the detector signals indicate a cumulative stack movement exceeding a threshold magnitude, a control means responds to actuate the stitch head.

A frame in accordance with the present invention can be supported by a variety of bearings, e.g., wheels, slides, etc, which permit the frame to be freely manually guided across a horizontally oriented planar surface supporting the frame.

A detector in accordance with the present invention can be configured in a variety of ways but preferably comprises an optical detector carried by the frame for responding to movement relative to the surface supporting the frame.

As described in applicant's U.S. Pat. No. 6,883,446, a system in accordance with the present invention can operate solely in an impulse mode, or solely in a continuous proportional mode, or as a dual mode system, i.e., impulse mode at slow stack speeds and proportional mode at higher stack speeds. A frame in accordance with the present invention can be integrated into a system which includes control circuitry especially designed to accept the detector signals for actuating the stitch head. Alternatively, a frame in accordance with the present invention can be used as an accessory to a conventional quilting/sewing machine by using the detector signals to control stitch head speed via an adapter coupled to the machine's conventional foot control.

BRIEF DESCRIPTION OF THE FIGURES

FIG. 7 (presented as 7(A) and 7(B)) comprises a flow chart depicting dual mode operation, i.e., (1) impulse mode and (2) proportional mode;

DETAILED DESCRIPTION

U.S. Pat. No. 6,883,446 is in its entirety incorporated herein by reference. However, for convenience sake, several of the figures and related text from that patent are expressly reproduced in this application, e.g., FIGS. 1-6, 7(A), 7(B) and 8 herein respectively correspond to FIGS. 1-6, 11(A), 11(B) and 16 of said patent.

Figure 1:
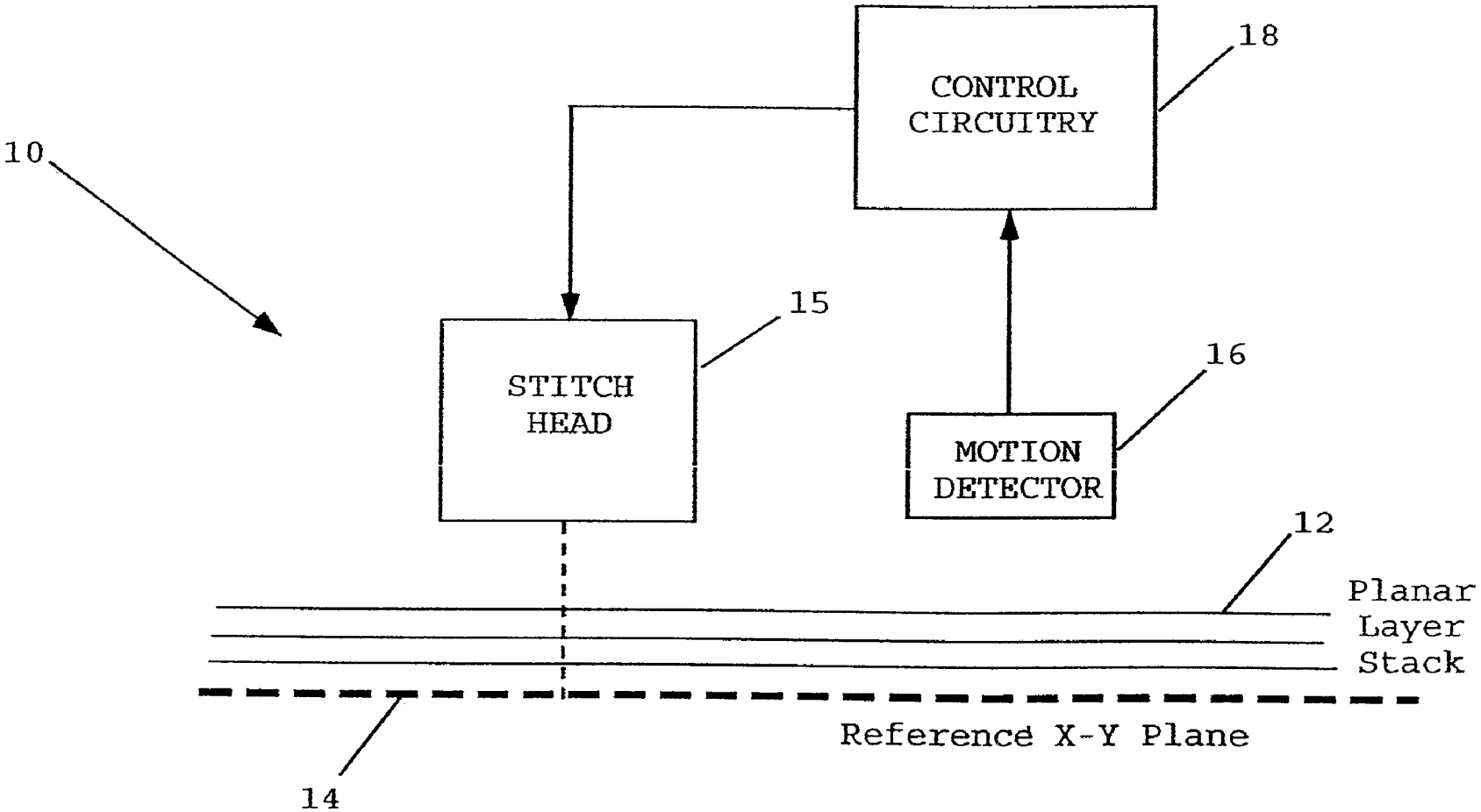
FIG. 1 is a generalized block diagram depicting a system for fastening stacked planar layers.

Attention is initially directed to FIG. 1 which depicts a generalized system 10 in accordance with the invention for fastening together two or more flexible planar layers, e.g., fabric forming a stack 12. The stack 12 is supported for guided free motion along a reference X—Y plane 14 proximate to a fastening, or stitch, head 15. The head 15 is actuatable to insert a fastener, or stitch, through the stacked layers 12 to fasten the layers together. A motion detector 16 is provided to sense the movement of stack 12 across plane 14. Control circuitry 18 responds to increments of stack movement to actuate the head 15 to insert uniform length stitches through the layers of stack 12. The detector 16 is preferably configured to measure the stack translational motion along perpendicular X, Y axes of reference plane 14 proximate to the stitch head 15.

Figure 2:
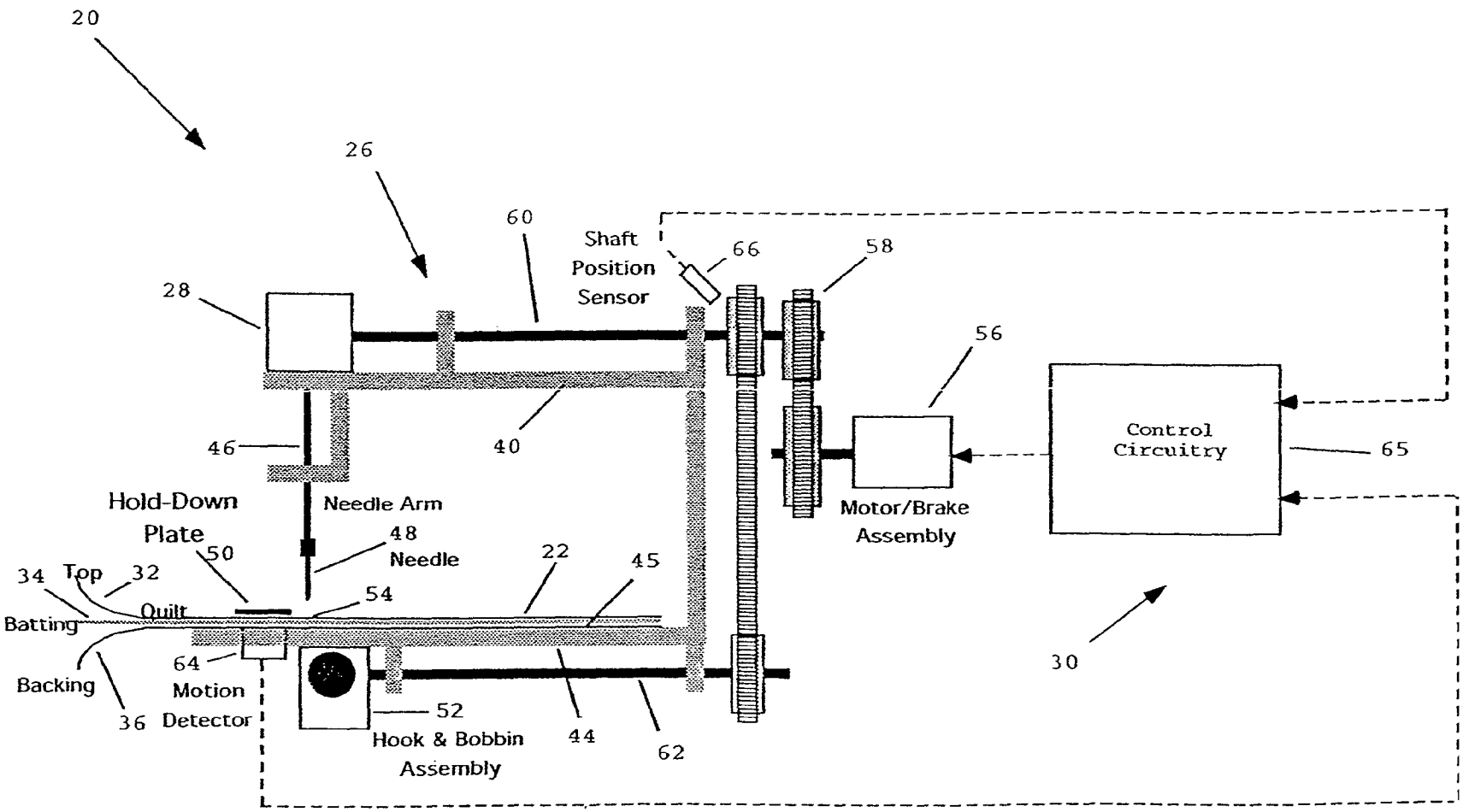
FIG. 2 is a diagrammatic illustration of an embodiment of the system of FIG. 1 utilizing a motor/brake assembly to control a stitch head in response to movement of a stack of fabric layers.

FIG. 2 illustrates one embodiment 20 of the system of FIG. 1 for stitching together fabric layers of a stack 22. The embodiment 20 is generally comprised of a mechanical machine portion 26, including an actuatable stitch head 28, and an electronic control subsystem 30 for actuating the head 28 in response to movement of the stack 22. The stack 22 is typically comprised of multiple fabric layers, e.g., a top layer 32, an intermediate batting layer 34, and a bottom backing layer 36, which when stitched together will form a quilt.

The machine portion 26 of FIG. 2 is generally comprised of a machine frame 40 configured to support the stitch head 28 above a bed 44 providing a substantially horizontally oriented planar surface 45. The stitch head 28 includes a needle bar 46 supporting a needle 48 for reciprocal or cyclic vertical movement essentially perpendicular the planar surface 45. The bed surface 45 is configured for supporting the layered stack 22 so as to enable a user to directly grasp, or touch, the stack 22 for guiding it across the surface 45 by manual push-pull action. A hold-down plate, or presser foot, 50 is preferably provided to selectively press the stack 22 against the bed surface to assure proper stitch tension and to assist the needle to pull upwardly out of the stack after inserting a stitch.

Figure 4:
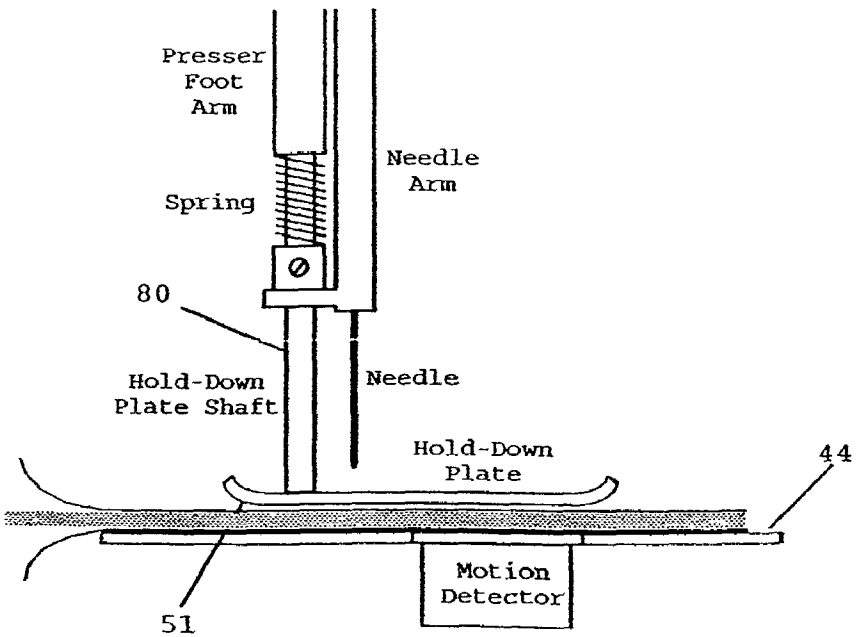
FIG. 4 is a diagrammatic illustration similar to FIG. 3 but showing the needle and hold-down plate in their up position.

A conventional hook and bobbin assembly 52 is mounted beneath the bed 44 in alignment with the needle 48. The stitch head 28 including needle bar 46 and needle 48, operates in a substantially conventional manner in conjunction with the hook and bobbin assembly 52 to insert a stitch through the stack 22 at a fixedly located opening, or stitch site, 54 on the bed. During a stitch cycle when the needle 48 is lowered to its down position to pierce the stack layers (FIG. 3), the hold-down plate 50 is also lowered to press the stack layers against the bed 44 to achieve proper stitch tension and assist the needle to pull up out of the stack. After completion of a stitch cycle, the needle 48 and hold-down plate 50 are raised (FIG. 4). The raised position of the hold-down plate (FIG. 4) is preferably selected to loosely bear against the stack to maintain the backing layer 36 (FIG. 2) against the bed 44 to assure detection by detector 16 while also permitting the stack to be freely moved across the bed 44.

The machine portion 26 of FIG. 2 is further depicted as including a motor/brake assembly 56 which functions to selectively provide operating power and braking via a suitable transmission system 58 to an upper drive shaft 60 and a lower drive shaft 62. The upper drive shaft 60 transfers power from the motor/brake assembly 56 to stitch head 28 for moving the needle 48. The lower drive shaft 62 transfers power from the motor/brake assembly 56 to the hook and bobbin assembly 52.

The stitch head 28 and hook and bobbin assembly 52 operate cooperatively in a conventional manner to insert stitches through the layers of stack 22 at stitch site 54. That is, when the stitch head cycle is initiated, needle 48 is driven downwardly to pierce the stacked layers 32, 34, 36 and carry an upper thread (not shown) through the stitch site opening 54 in bed 44. Beneath the bed 44, the hook (not shown) of assembly 52 grabs a loop of the upper thread before the needle 48 pulls it back up through the stack which is held down by presser foot 50. The upper thread loop grabbed by the hook is then locked by a thread pulled off the bobbin (not shown) of assembly 52.

The system of FIG. 2 includes a transducer, or detector, 64 for detecting the movement, or more specifically, the translation of the stack 22 on bed 44 for the purpose of controlling the motor/brake assembly 56 via control circuitry 65. In operation, a user is able to freely move the layered stack 22 on bed 44 relative to the fixedly located stitch head 28 while the detector 64 produces electronic signals representative of the stack movement. Control circuitry 65 then responds to the detected stack movement for controlling the issuance of a stitch from head 28. The control subsystem 30, in addition to including motion detector 64 and control circuitry 65, also preferably includes a shaft position sensor 66. The shaft position sensor 66 functions to sense the particular rotational position of the upper drive shaft 60 corresponding to the needle 48 being in its full up position. The control circuitry 65 preferably responds to the output of sensor 66 to park the needle 48 in its full up position between successive stitch cycles. This action prevents the needle from interfering with the free translational movement of the stack 22 on bed 44.

In typical use, an operator directly touches the fabric stack to manually guide it across the horizontally oriented bed 44 beneath the vertically oriented needle 48. The motion detector 64 in accordance with the invention is mounted to monitor a target area coincident with a surface layer (top and/or bottom) of the stack 22 as the stack is moved across the bed 44. The detector can be considered as having a window focused on the stack surface proximate to the needle penetration site. The detector can be variously physically mounted; e.g., above the stack looking down at the stack top surface or below the stack looking up at the stack bottom surface.

Although the motion detector 64 of FIG. 2 can take many different forms, including both noncontacting devices (e.g., optical detector) and contacting devices (e.g., track ball), it is much preferred that it detect stack movement without physically contacting the fabric layers. Accordingly, a preferred motion detector comprises a device for responding to energy reflected from, or sourced by, the stack. Although this energy can be of several different forms (e.g., ultrasonic, RF, magnetic, electrostatic, etc.), a preferred detector employs an optical motion detector utilizing, for example, an optical chip ADNS2051 marketed by Agilent Technologies. Alternative detectors for measuring stack movement can employ technologies such as accelerometers, resistive devices, etc.

Figure 3:
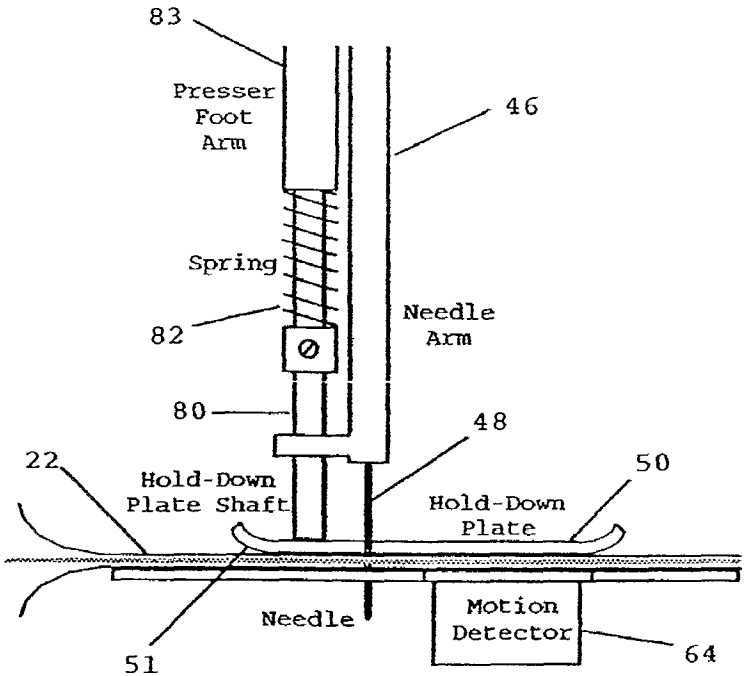
FIG. 3 and is a diagrammatic illustration showing the stitch needle and hold-down plate of FIG. 2 in their down position.

Suffice it to say that the accurate measurement of stack movement depends, in part, upon the stack target layer, e.g., backing layer 36, being positioned near the focus of the motion detector window. The aforementioned hold-down plate or presser foot 50 assists in maintaining the stack layers at a certain distance from the detector window. In a preferred embodiment, the hold-down plate 50 has a flat smooth bottom surface 51 for engaging the stack 22 and is fabricated of transparent material to avoid obstructing a user's view of the stack layers proximate to the needle 48. FIGS. 3 and 4 respectively illustrate the actuated and non actuated positions of the hold-down plate 50. In FIG. 3, shaft 80 is moved down during the stitch cycle to cause the plate 50 to apply spring pressure, attributable to spring 82, to the stack 22. Between cycles (FIG. 4), shaft 80 is moved up so the pressure of plate 50 against stack 22 is relieved to reduce motion-inhibiting friction of the plate against the stack. Nevertheless, during a non-stitch interval between cycles, the plate 50 is positioned closely enough to loosely hold the stack against the bed 44.

Note in FIGS. 3 and 4 that the hold-down plate 50 is attached to shaft 80 that slides, loaded by spring 82, up and down, relative to a presser foot arm 83. Also note that FIG. 4 shows the needle arm 46 assisting to pull the spring-loaded shaft 80 upwardly. The travel range of the hold-down plate 50 permits free horizontal motion of the quilt stack across the bed between stitch cycles but constrains vertical motion of the stack sufficiently to assure that the backing layer surface 36 is held against the bed surface and near the focus of the window of motion detector 64.

Figure 5:
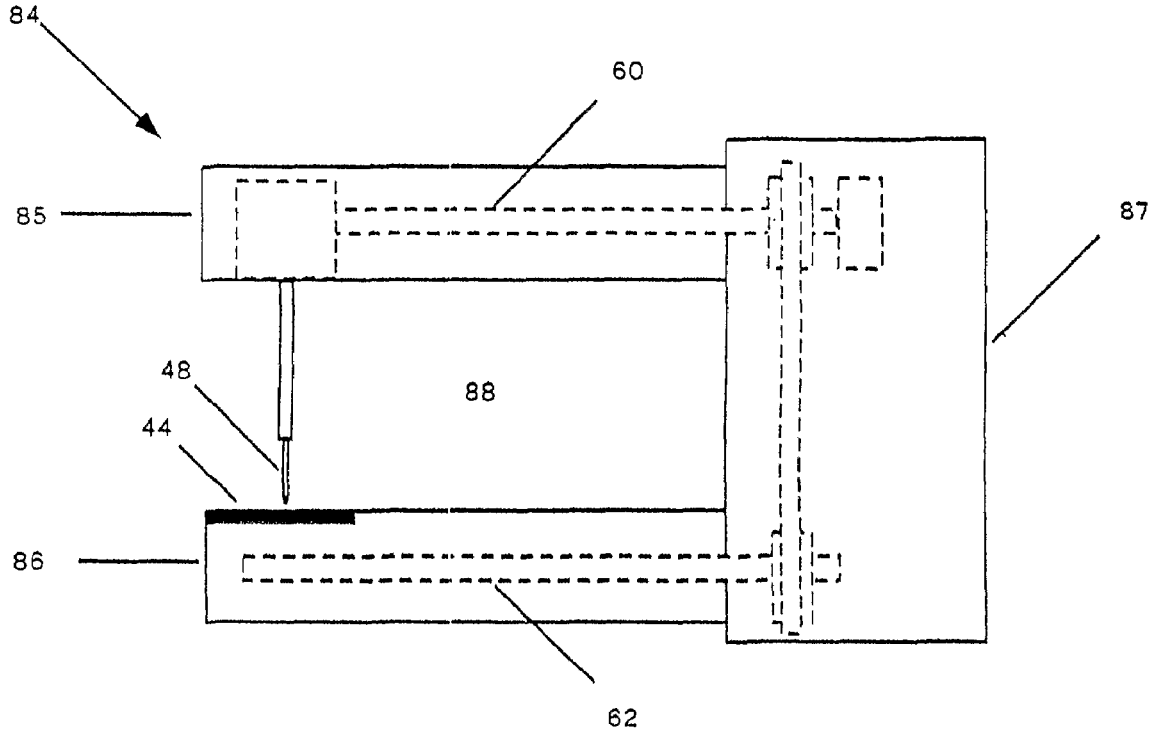
FIGS. 5 and 6 respectively show side and end views of an exemplary quilting/sewing machine housing.
Figure 6:
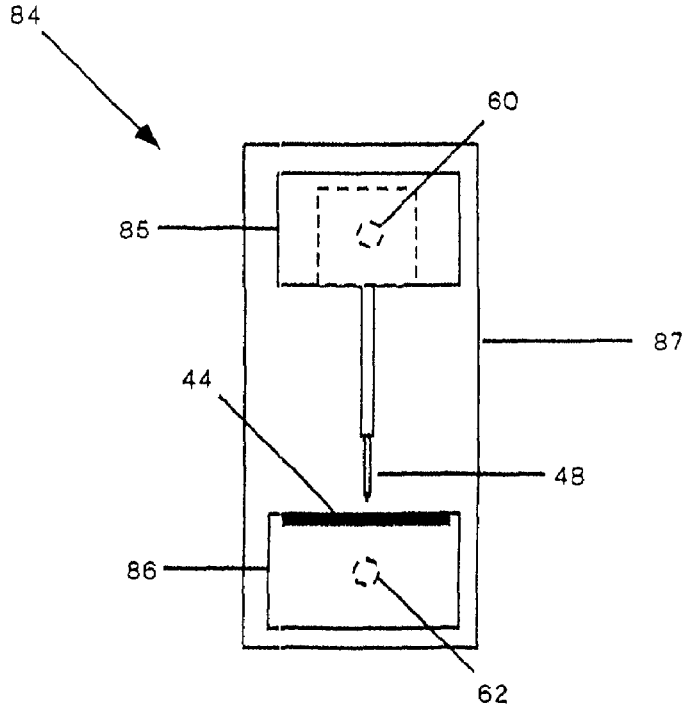

FIGS. 5 and 6 schematically depict a typical quilting/sewing machine housing 84 for accommodating the physical components of the system of FIG. 2. The housing 84 comprises an upper arm 85 which contains the upper drive shaft 60 and a lower arm 86 containing the lower drive shaft 62. The housing upper and lower arms 85 and 86 extend from a vertically oriented machine arm 87. The upper and lower arms 85, 86 are vertically spaced from one another and together with the machine arm 87 define a space which is generally referred to as the throat space 88. The needle 48 descends vertically from the upper arm into the throat space 88 for reciprocal movement toward and away from the lower arm 85. The lower arm 85 carries the bed 44 which is sometimes referred to as the throat plate. The distance between the needle and the machine arm is generally referred to as the throat length.

Attention is now directed to FIG. 7(A, B) which comprises a flow diagram depicting the algorithmic operation of microcontroller 98 for controlling the motor/brake assembly 56 of FIG. 2. In FIG. 7, first note block 120 which functions to initialize a stitch cycle by acquiring a "stitch length" value which typically was previously entered via a user input. With the stitch length value set in block 120, the algorithm proceeds to decision block 122 which tests for stack translation in the X direction, i.e., for an X pulse on lead 96 from the optical chip 95. If a pulse is detected, then a store X count is incremented, as represented by block 124. After execution of blocks 122, 124, operation proceeds to decision block 126 which tests for Y translation, i.e., for a Y pulse out of the detector 64. If a Y pulse is detected, then a stored Y count is incremented as represented by block 128. Operation then proceeds from blocks 126 or 128 to block 130. Blocks 130 and 132 essentially represent steps for determining the resultant stack movement magnitude attributable to the measured X and Y components of motion utilizing the Pythagorean theorem. That is, in block 130, the X count value is squared and the Y count value is squared. Block 132 sums the squared values calculated in block 130 to produce a value representative of the resultant stack movement.

Block 134 compares the square of the preset switch length value with the magnitude derived from block 132. If the magnitude of the resultant movement is less than the preset stitch length, then operation cycles back via loop 136 to the initial block 120. If on the other hand, the resultant magnitude exceeds the preset stitch length, then operation proceeds to block 138 to initiate a stitch. In block 140, the X and Y counts are cleared before returning to the initial block 120.

FIG. 7(A) as discussed thus far relates primarily to operation in the impulse, or single stitch, mode. FIG. 7B depicts dual mode operation, i.e., impulse mode at slow stack speeds and a continuous proportional mode at higher stack speeds. It is preferable to provide such a dual mode capability to be able to operate more smoothly at higher stack speeds. By way of explanation, it will be recalled that in order to accommodate slow stack speed operation, e.g., less than 20 inches per minute, it is desirable that each stitch command initiate a very rapid needle stroke to avoid the needle interfering with stack movement. As the stack translation speed and needle stroke rate increase, the needle's interference with stack movement diminishes. Thus, at fast stack speeds, e.g., greater than 20 inches per minute (or 200 stitches per minute assuming an exemplary 0.1 inch stitch length), it is appropriate to switch to a proportional mode in which the needle is continuously driven at a rate substantially proportional to the speed of stack translation. At a speed of 200 stitches per minute, each needle cycle consumes less than about 300 milliseconds. Accordingly, the algorithm depicted in FIG. 7(B) includes a step which tests for the time duration between successive stitch commands, i.e., a stitch time interval. If the duration of this interval is less than an exemplary 300 milliseconds, then operation proceeds in the proportional mode. FIG. 7(B) shows that block 138 is followed by block 152 which reads and resets a stitch interval timer (which can be readily implemented by a suitable microcontroller) which times the duration between successive stitch commands and records the angular position en of the needle drive shaft 60 (block 153). Decision block 154 then tests the interval timer duration previously read in block 152 to determine whether it is greater than the aforementioned exemplary 300 millisecond interval. If yes, operation proceeds to the impulse mode 155. If no, operation proceeds to the proportional mode 156.

Operation in the impulse mode 155 involves block 157 which is executed to assure deactivation of the proportional mode. Thereafter, block 148 is executed which involves waiting for a signal from the bobbin hook sensor. The motor (or clutch) is then actuated in block 142 and actuation terminates when a terminating pulse is recognized from the shaft position sensor (block 146). Block 158 then deactuates a motor/clutch relay and/or actuates a brake after a stitch recognized in block 146 to park the needle in its up position.

Operation in the proportional mode 156 includes step 159 which activates motor speed control operation. A motor speed control capability is a common feature of most modern sewing machines with motor speed being controlled by the user, e.g., via a foot pedal, and/or by built-in electronic control circuitry.

After block 159, decision block 160 is executed. To understand the function of decision block 160, it must first be recognized that as stack speed is increased, thus generating shorter duration stitch intervals, the shaft angle position $\Theta_n$ read in block 153 will decrease, in the absence of an adjustment of motor/needle shaft speed. In other words, a newly read shaft angle $\Theta_n$ will be smaller than a previously read shaft angle $\Theta_p$. Block 160 functions to compare $\Theta_n$ and $\Theta_p$ if stack speed increases. If $\Theta_n$ is smaller, the motor speed must be increased (block 161) to deliver stitches at an increased rate to maintain stitch length uniformity.

On the other hand, if stack speed is reduced so that $\Theta_n$ is greater than $\Theta_p$, motor speed is decreased (block 162) in order to produce uniform length stitches. If stack speed remains constant, then $\Theta_n$ equals $\Theta_p$ and no motor sped adjustment is called for (block 163).

The embodiments thus far described primarily contemplate that the motion detector and control circuitry, be fully integrated into a quilting/sewing machine. However, it is recognized that alternative embodiments of the invention can be provided which are more suitable for after market adaptation of a conventional sewing machine. More particularly, attention is directed to FIG. 16 which depicts a conventional sewing machine 250 having a drive motor 252. The drive motor is typically controlled by motor control circuitry 254 which can control motor speed and other aspects or motor operation. Motor speed is typically controlled by a user input provided by a foot control 256 via a cable 258 and plug 260 which mates with a connector 262. The essential functionality of FIG. 1 can be introduced into the conventional machine 250 by plugging a stitch control module 264 into connector 262 in place of original foot control 256 to operate the needle at a rate proportional to movement of a fabric stack. The module 264 is comprised of a motion detector 266, as previously discussed, mounted to measure stack movement within the throat space of machine 250. The detector 266 is connected to control circuitry 268 which drives a foot control adapter 270. The adapter 270 is configured to accept speed control input commands from control circuitry 268 and, in turn, output commands, i.e., control signals which simulate those provided by the original foot control 256. The adapter output control signals are coupled via cable 272 to plug 274 for mating with connector 262. Inasmuch as different machines may have different interfaces for coupling the original foot control 256 to the connector 262 and motor control circuit 254, the foot control adapter 270 and plug 274 should be configured to be compatible with the particular sewing machine being adapted.

The embodiments specifically discussed thus far primarily contemplate detecting stack surface movement within the throat space of a quilting/sewing machine to control stitch head actuation for producing uniform stitches. FIGS. 9-13 illustrate alternative embodiments of the invention in which the fabric stack is retained on a mounting frame supported for manually guided movement and the frame is coupled to a motion detector which generates signals indicating frame, and thus stack, translation.

Figure 9:
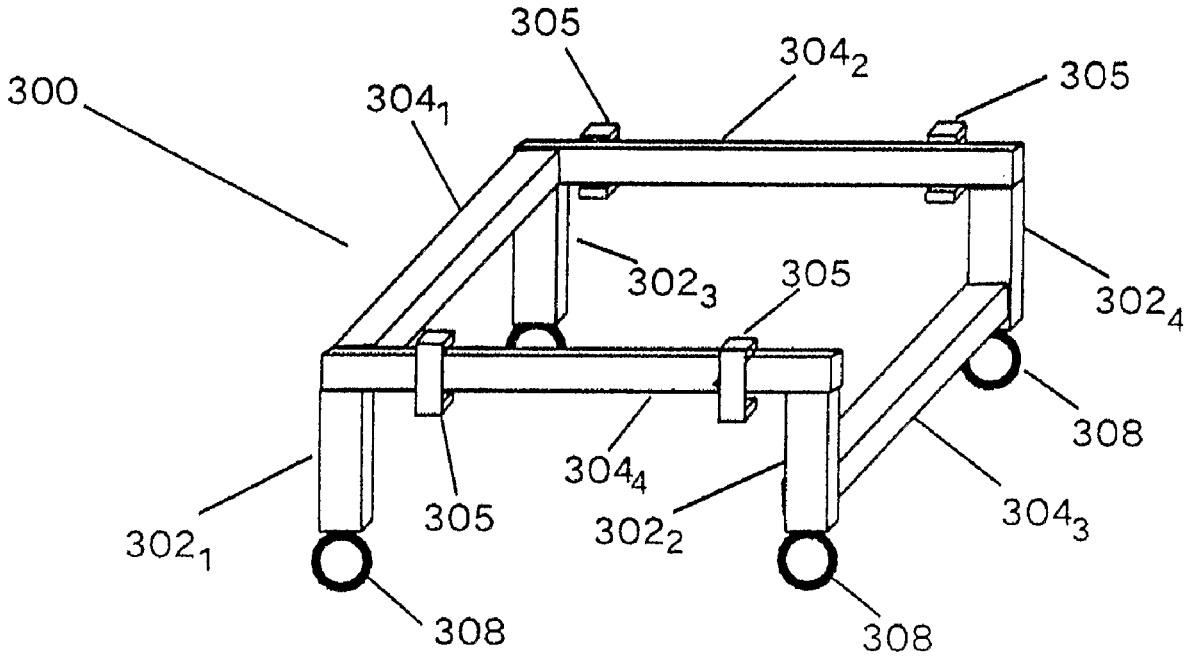
FIG. 9 is an isometric view of an exemplary fabric retaining frame which can be used in accordance with the present invention.
Figure 10:
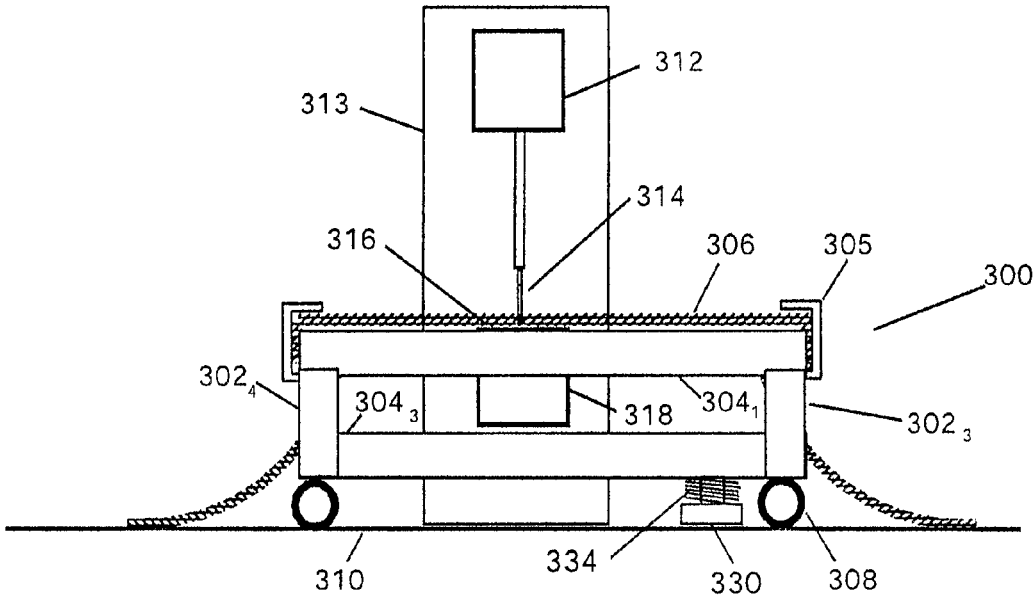
FIGS. 10 and 11 respectively show end and top views depicting a frame supported for hand guided movement beneath a stitch head and a motion detector carried by the frame for producing frame translation signals.

More particularly, note that FIG. 9 depicts a rectangular frame 300 comprised of vertical members $\mathbf{302}_1$, $\mathbf{302}_2$, $\mathbf{302}_3$, $\mathbf{302}_4$. Rails $\mathbf{304}_1$, $\mathbf{304}_2$, $\mathbf{304}_3$, $\mathbf{304}_4$ respectively interconnect the vertical members to form a substantially rigid rectangular frame (which can of course be configured to collapse to conserve storage space). Opposed rails $\mathbf{304}_2$ and $\mathbf{304}_4$ are provided with clamps 305 for retaining the fabric stack 306 thereon, as depicted in FIG. 10, in a substantially taut condition.

Each vertical member 302 is supported on some type of bearing 308, preferably a wheel or slide, for engaging a horizontally oriented bed or table surface 310. The bearings 308 enable a user to push/pull the frame 300 to manually guide the frame over surface 310 relative to fixedly located stitch head 312 of machine 313. The stitch head 312 includes a needle 314 mounted for cyclic vertical movement from an up position remote from the plate 316 to a down position penetrating a needle opening in plate 316 and then back to the up position.

The frame vertical members 302 and bearings 308 are dimensioned to hold the stack 306 clamped to rails $\mathbf{304}_2$ and $\mathbf{304}_4$ at a height appropriate to enable the stack lower surface to ride on the plate 316 (mounted on machine lower arm 318) as the frame 300 translates across the table surface 310. As can be seen in FIG. 9, rail $\mathbf{304}_3$ is preferably mounted lower than rails 304, $\mathbf{304}_2$, $\mathbf{304}_4$ to allow the machine lower arm 318 to extend into the space between rails $\mathbf{304}_2$ and $\mathbf{304}_4$ to position the plate 316 adjacent to the stack lower surface.

In accordance with the present invention, a motion detector 330 is coupled to the frame 300 for producing signals representing frame translational movement along perpendicular X and Y axes. Although various types of detectors can be used, it is preferred that detector 330 comprises an optical detector for responding to light reflected from table surface 310. As previously noted, such a detector can employ an optical chip of the type marketed by Agilent Technologies, e.g., ADNS2051, which can respond to the reflected light to produce X and Y signals representative of the frame and stack translational movement.

Although an optical detector responsive to reflected light appears to be the preferred choice, it is recognized that the detector 330 can be selected to respond to other forms of energy (e.g., ultrasonic, RF, magnetic, electrostatic, etc.) reflected from, or sourced by, the surface 310. Alternatively, other types of detectors for measuring frame movement can employ technologies such as accelerometers, resistive devices, encoders having wheels positioned to roll on surface 310, etc.

FIG. 10 depicts the detector 330 in a preferred location on frame 300 suspended from the lower rail 3043 to place it close to the table surface 310 and in a place to avoid interfering with the user manipulation of frame 300. As shown, it is preferred that the detector be suspended by a mounting including spring 334 to protect it from physical shock.

Figure 11:
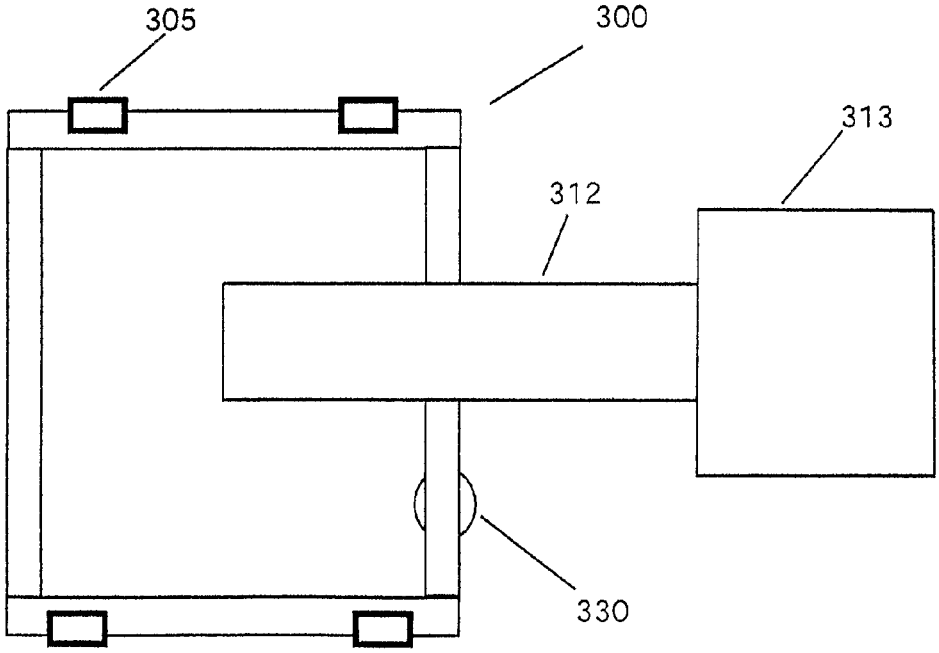
Figure 12:
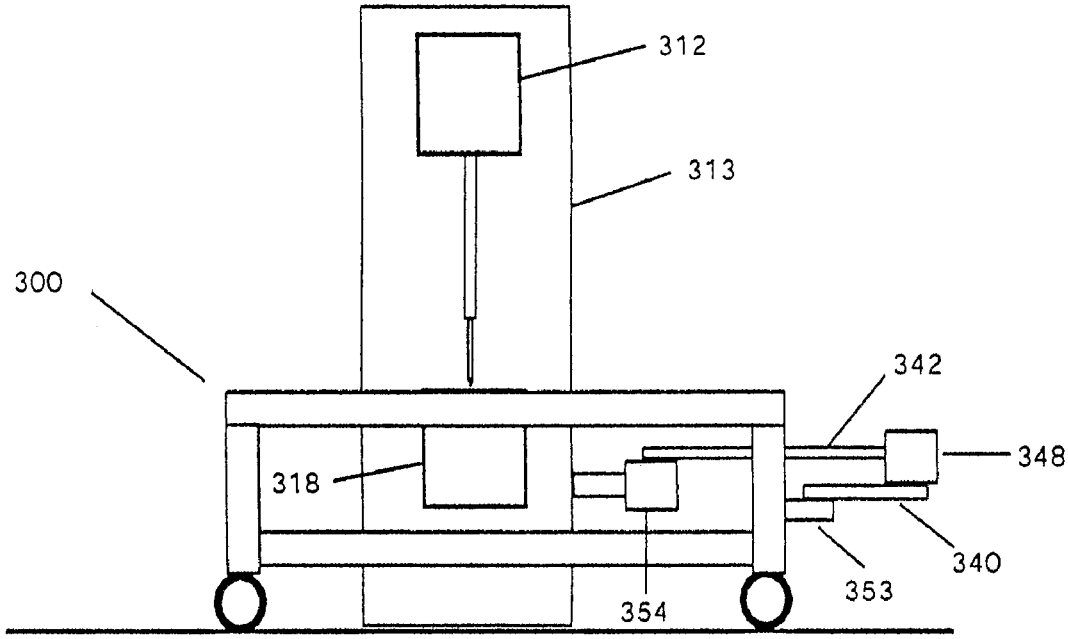
FIGS. 12 and 13 respectively show end and top views depicting a movable frame similar to FIGS. 10 and 11 but utilizing an electromechanical resolver to produce frame translation signals.
Figure 13:
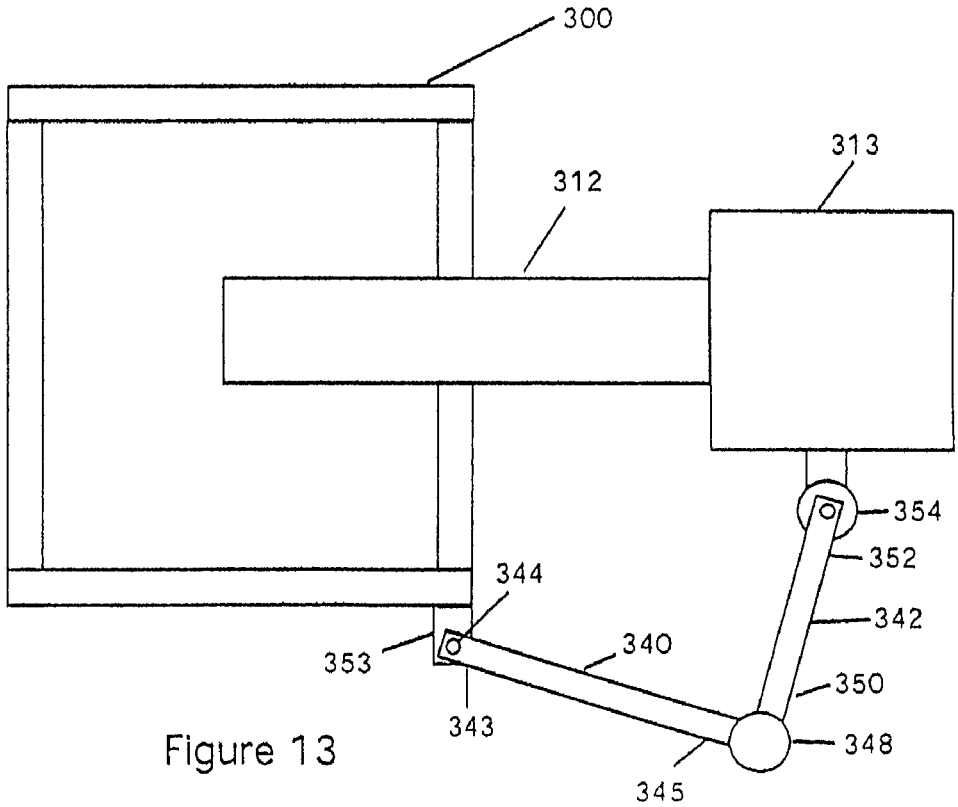

FIGS. 12 and 13 illustrate an exemplary embodiment alternative to the embodiment depicted in FIGS. 10 and 11. In FIGS. 12 and 13, the frame 300 is coupled to the machine 313 by first and second rigid arms 340 and 342. A first end 343 of arm 340 is hinged around pin 344 mounted on frame 300. A second end 345 is coupled to a sensor 348 for measuring angular movement between arms 340 and 342. A first end 350 of arm 342 is coupled to sensor 348 and a second end 352 is coupled to sensor 354 which measures angular movement between arm 342 and projection 353 fixed to machine 313. The sensors 348 and 352 provide signals representative of angular motion of arms 340 and 342 which can be used to produce X and Y frame translation signals for controlling stitch head actuation.

Figure 8:
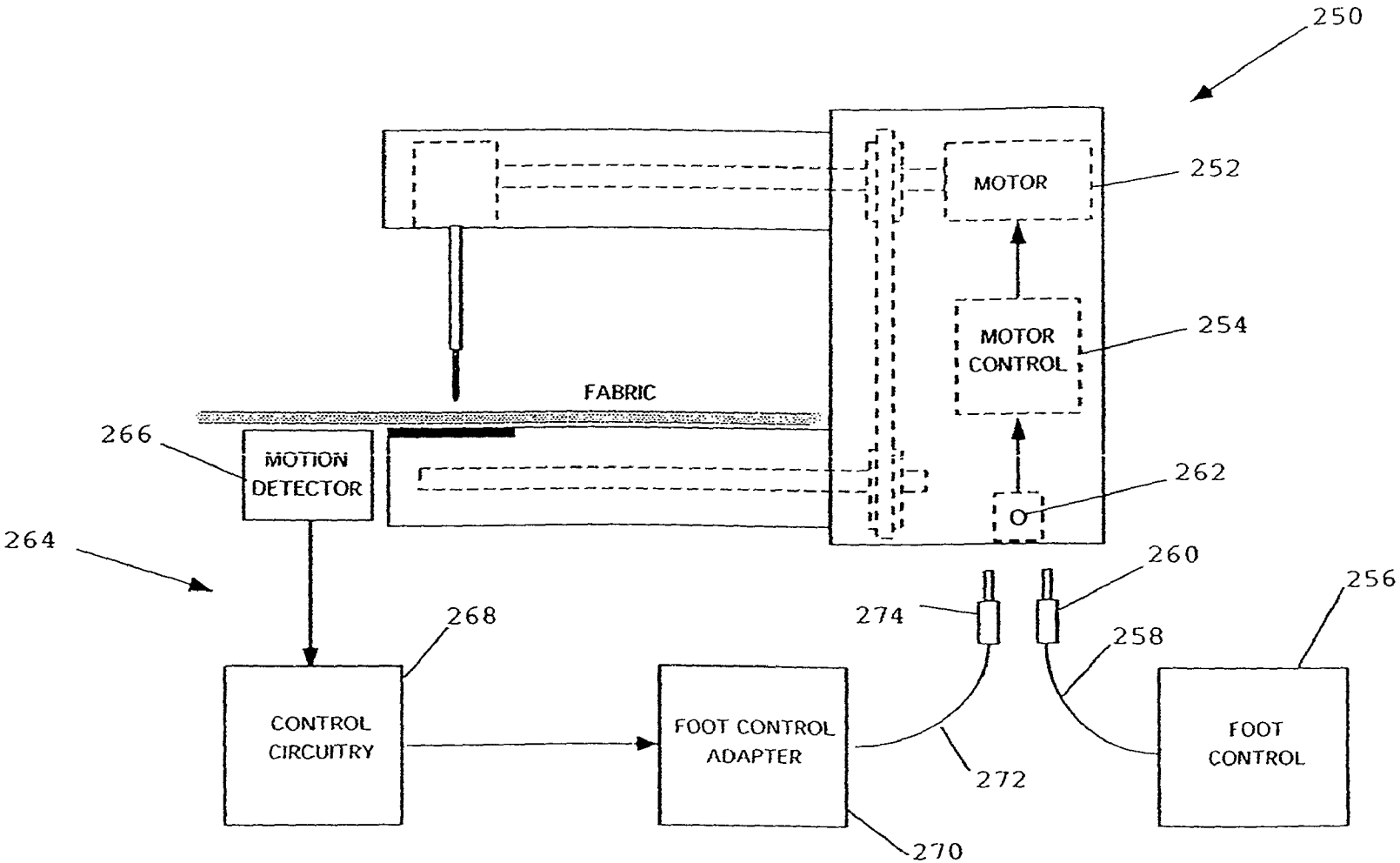
FIG. 8 is a block diagram depicting how a conventional sewing machine can be adapted to respond to movement of a fabric layer stack.

The frame translation signals provided by detector 330 (FIGS. 10, 11) and by sensors 348, 354 (FIGS. 12, 13) are provided to control circuitry in the same manner as represented in FIGS. 1 and 8 to control stitch head actuation in the impulse mode and/or proportional mode as described in FIGS. 7(A) and 7(B).

From the foregoing, it should now be appreciated that applicant has described various frame embodiments for mounting a multilayer stack, typically fabric quilt materials, which can be readily manually moved by a user beneath a stitch head to control actuation of the stitch head and cause it to insert uniform stitches through the stack. Although only a limited number of embodiments have been illustrated, it will be recognized that various modifications and alternatives will occur to those skilled in the art which embody the spirit of the invention and fall within the intended scope as defined by the appended claims.

The invention claimed is:

1. An apparatus for free motion stitching and for inserting stitches of uniform length through a stack of one or more fabric layers as said stack is manually guided in a substantially horizontal plane, said apparatus comprising:

a fixedly located stitch head including a needle mounted for cyclic vertical movement;

a bed defining a substantially horizontally oriented first planar surface mounted opposite to said stitch head;

a frame configured to retain said fabric layer stack in a substantially taut condition adjacent to said first planar surface;

at least one bearing supporting said frame for manually guided movement to move said stack across said first planar surface;

a detector for producing one or more signals representing the magnitude of translational movement of said frame; and control circuitry responsive to said detector signals indicating a magnitude of translational movement exceeding a threshold magnitude for causing said needle to execute a cyclic movement from an up position remote from said stack, to a down position piercing said stack, and back to said up position.

2. The apparatus of claim 1 wherein said at least one bearing comprises a wheel.

3. The apparatus of claim 1 wherein said at least one bearing comprises a slide member.

4. The apparatus of claim 1 wherein said detector is coupled to said frame for movement therewith.

5. The apparatus of claim 4 wherein said detector comprises an optical detector responsive to light reflected from said second planar surface.

6. The apparatus of claim 1 wherein said detector comprises at least one arm linked to said frame for movement therewith and means responsive to movement of said arm for producing said signals.

7. A method of forming successive stitches of uniform length while free motion stitching through a stack of fabric layers, said method comprising:

mounting an actuatable stitch head at a fixed location above a planar surface;

mounting a stack of fabric layers to a frame;

manually moving said frame to guide said stack across said planar surface;

detecting the movement of said frame; and actuating said stitch head in response to a magnitude of frame movement greater than a threshold magnitude to cause a needle in said stitch head to move from an up position remote from said stack, to a down position piercing said stack, and back to said up position.

8. The method of claim 7 wherein stitch head is actuated at a rate proportional to the rate of translational movement of said frame.

9. A method of forming successive stitches of uniform length while free motion stitching through a stack of fabric layers, said method comprising:

mounting an actuatable stitch head at a fixed location above a planar surface;

mounting a stack of fabric layers to a frame;

manually moving said frame to guide said stack across said planar surface;

detecting the movement of said frame; and controlling said stitch head to cause a needle to execute cyclic movements at a rate proportional to the speed of movement of said frame.

10. An apparatus for free motion stitching and for inserting stitches of uniform length through a stack of one or more fabric layers as said stack is manually guided in a substantially horizontal plane, said apparatus comprising:

a fixedly located stitch head including a needle mounted for cyclic vertical movement;

a bed defining a substantially horizontally oriented first planar surface mounted opposite to said stitch head;

a frame configured to retain said fabric layer stack in a substantially taut condition adjacent to said first planar surface;

at least one bearing supporting said frame for manually guided movement across a substantially horizontally oriented second planar surface to move said stack across said first planar surface;

a detector for measuring the movement of said frame across said second planar surface; and control circuitry for causing said needle to execute cyclic movements at a rate substantially proportional to the rate of frame movement measured by said detector.

11. Apparatus for use in combination with a sewing machine which includes a drive subsystem configured to cycle a needle through a path of vertical movement from an up position to a down position and back to said up position, said apparatus comprising:

a frame;

means for removably securing a stack of one or more fabric layers to said frame;

bearing means mounting said frame for hand guided movement across a planar surface;

detector means for producing signals representing the magnitude of translational movement of said frame across said planar surface; and means for coupling said signals to said drive subsystem to synchronize the cycle rate of said needle to the translational movement of said frame.

12. The apparatus of claim 11 wherein said bearing means comprises at least one wheel.

13. The apparatus of claim 11 wherein said detector means produces signals representing the magnitude of frame translation along first and second perpendicular directions.

14. The apparatus of claim 11 wherein said means for coupling is adapted to apply said signals to said drive subsystem to initiate a needle cycle in response to frame translation exceeding a threshold magnitude.

15. The apparatus of claim 11 wherein said drive subsystem includes speed control circuitry; and wherein said means for coupling is adapted to apply said signals to said speed control circuitry.

* * * * *